US008304999B2

(12) United States Patent
Yang

(10) Patent No.: US 8,304,999 B2
(45) Date of Patent: Nov. 6, 2012

(54) LED CONTROLLING DRIVER AND CONTROLLING METHOD THEREOF

(75) Inventor: Chin-Hsin Yang, Taipei (TW)

(73) Assignee: Sunpaltech Co., Ltd., Taipei (TW)

( * ) Notice: Subject to any disclaimer, the term of this patent is extended or adjusted under 35 U.S.C. 154(b) by 368 days.

(21) Appl. No.: 12/685,664

(22) Filed: Jan. 11, 2010

(65) Prior Publication Data

US 2010/0308744 A1 Dec. 9, 2010

Related U.S. Application Data

(60) Provisional application No. 61/184,856, filed on Jun. 8, 2009, provisional application No. 61/185,214, filed on Jun. 9, 2009.

(51) Int. Cl.
*H05B 37/02* (2006.01)

(52) U.S. Cl. ..... 315/209 R; 315/246; 315/291

(58) Field of Classification Search ..... 315/209 R, 315/246, 276, 291, 362
See application file for complete search history.

(56) References Cited

U.S. PATENT DOCUMENTS

| | | | | |
|---|---|---|---|---|
| 7,908,037 | B2 * | 3/2011 | Nerone et al. | 700/296 |
| 2004/0160196 | A1 * | 8/2004 | Wong | 315/291 |
| 2005/0057188 | A1 * | 3/2005 | Wong et al. | 315/291 |
| 2006/0186830 | A1 * | 8/2006 | Shami et al. | 315/291 |

* cited by examiner

*Primary Examiner* — Thuy Vinh Tran
(74) *Attorney, Agent, or Firm* — Wang Law Firm, Inc.; Li K. Wang; Stephen Hsu

(57) ABSTRACT

The present invention discloses a LED controlling driver comprising light emitting diodes and a detection-control module and a power supply unit in addition to the light source. The detection-control module includes a power/blinking control unit and a LED driver IC. The power supply unit outputs power to the light source and the detection-control module and provides different switching information so that the LED drive unit of the detection-control module is controlled by power/blinking control signals. Further, a power switch enables the power supply unit to output the corresponding switching information to the detection-control module based on switching actions inputted by a user so that the user only needs to simply switch the power switch to achieve the goal of switching power levels or blinking states of the LED.

21 Claims, 7 Drawing Sheets

LED CONTROLLING DRIVER AND CONTROLLING METHOD THEREOF

BACKGROUND OF THE INVENTION

1. Field of the Invention

The present invention relates to a LED controlling driver and a controlling method thereof, and more particularly to a LED controlling driver, the controlling driver can control and drive the power levels or the blinking states of a light source comprises at least one light emitting diode, and a controlling method thereof.

2. Description of the Prior Art

Since Cavemen flared the first ray by fire in the remote antiquity, human beings have constantly pursued light in order to resist the darkness. In addition to the gas lamp, Edison invented an approach to use the new energy of electricity on October 1879, and further contributed to the birth of mercury light bulb. Following the advance of technology, human life become more convenient with invention of the LED, simultaneously, decreasing air pollution caused by lots of gas lamps and heavy-metal pollution by mercury light bulb; it is a great contribution to prevent the greenhouse effect and maintain the environment.

LEDs are special diodes. When a forward bias is applied, electrons and holes move in the semiconductor thin film and thus recombine with each other in the light-emitting layer due to the potential difference incurred from the external electrical field. At this time, part of the energy released by the recombination of the electron and hole pairs excites the luminescent molecules in the light-emitting layer to excited-state molecules. When the excited-state molecules fall back to the ground state, a certain portion of the energy is released in light form.

As technology progressing, LEDs emitting light of various colors (wavelengths) can be manufactured today. There are early-stage LEDs capable of emitting infrared rays or red light using gallium arsenide (GaAs) or aluminum gallium arsenide (AlGaAs). Besides, there are aluminum gallium phosphide (AlGaP) and gallium nitride (GaN) LEDs which emit green light and zinc selenide (ZnSe) and silicon carbide (SiC) LEDs which emit blue light, etc.

The luminous intensity (brightness) of an LED mainly depends upon the current going through the LED. The brightness is directly proportional to the current. Namely, higher brightness is obtained when a higher current passes through the LED, whereas the brightness is relatively lower when lower current passes through it. However, if a high current continues to be provided to the LED for the requirement of higher brightness, it will cause the problem of a decreased service life of the light emitting diode, high power consumption, or the like.

In order to solve the above-described problems, the prior art as shown in FIG. 1, which discloses a light emitting diode brightness control circuit 100. The light emitting diode brightness control circuit 100 is suitable for controlling the luminous brightness of multiple sets of light emitting diodes 130 used as a light source in a liquid crystal display. The light emitting diode brightness control circuit 100 comprises a brightness control pulse generation unit 110 and a plurality of light emitting diode direct current power supply units 121. The brightness control pulse generation unit 110 is used for receiving a brightness adjusting signal and generating multiple sets of brightness control pulse signals of the same frequency but with different phases based on the brightness adjusting signal. The duty cycles of the brightness control pulse signals change within a preset range based on the brightness adjusting signal. The light emitting diode direct current supply units are coupled to the brightness control pulse generation unit 110 to drive the corresponding light emitting diodes 130 based on the brightness control pulse signals.

However, the prior art still has the following problems to be overcome:

(1) Additional control circuits for controlling the brightness levels or the blinking states must be added so as to increase the cost. Thus, it is undesirable for indoor illumination due to its high price.

(2) Due to the lack of a detection-control module of the present invention, the power source cannot be operated by a user's switching operation so that the circuits cannot be driven to change the brightness level of the light source. Therefore, it is inconvenient in use.

SUMMARY OF THE INVENTION

In light of the aforementioned problems of the prior art, an object of the present invention is to provide a special design of an LED controlling driver for integration of power switch, so as to achieve the goal of suitably adjusting the power levels or blinking states of LEDs or a combination thereof according to the requirements of the user. The LED controlling driver according to the present invention comprises a light source, a detection-control module, and a power supply unit. The light source comprises at least one light emitting diode, and the light source may be set to a plurality of switchable power levels or in a plurality of switchable blinking states. The detection-control module is coupled to the above-described light source, and includes a power/blinking control unit and a LED drive unit. The power/blinking control unit can generate a power/blinking control signal based on switching information to control one of the power levels or the blinking states of the plurality of light emitting diodes of the light source or a combination thereof. The LED drive unit provides intensity of driving electric power corresponding to the actuation threshold of the light emitting diodes of the light source. The power supply unit supplies switching power to the light source and the detection-control module, whereby various switching information is provided to the detection-control module.

Furthermore, the present invention comprises a power switch that enables the power supply unit to output the switching information corresponding to the switching action inputted by the user, so as to control the light emitting diodes of the light source.

Furthermore, a power conversion device is disposed between the light source and the detection-control module according to the present invention for receiving driving electric power corresponding to the intensity of driving electric power, which is outputted by the power supply unit. The driving electric power is switching power. The power conversion device may also include a voltage transformer, a rectifier and a feedback device. The voltage transformer transfonus the magnitude of a voltage of the driving electric power; the rectifier converts a current of the driving electric power into a direct current; the feedback device provides a conversion gain value to control the driving electric power.

Furthermore, the present invention may also comprise a power memory unit and a power pulse unit. The power memory unit is coupled to the detection-control module to provide the detection-control module with maintaining power so that the detection-control module can memorize a power value corresponding to the power levels. The power pulse unit provides a power pulse signal based on the switching information so that the detection-control module can load the power value corresponding to the above-described power levels. The above-described power memory unit may be one of a capacitor circuit, an RC circuit, a diode switch circuit, a transistor switch circuit, or a combination thereof. The power control signal may be a current control signal, and the power levels of the light emitting diodes may have a stagewise increasing or stagewise decreasing relationship with respect to the current control signal.

Furthermore, the present invention comprises a blinking state memory unit and a blinking state pulse unit. The blinking state memory unit is coupled to the detection-control module to provide the detection-control module with maintaining power so that the detection-control module can memorize a blinking state value corresponding to the blinking states. The blinking state pulse unit provides a blinking state pulse signal based on the switching information so that the detection-control module can load the blinking state value corresponding to the above-described blinking states. The above-described blinking state memory unit may be one of a capacitor circuit, an RC circuit, a diode switch circuit, a transistor switch circuit, or a combination thereof. The flicker control signal may be a switching clock signal. The blinking state memory unit may be provided for inputting/outputting signals and be cascaded with an LED controlling driver in the former and/or later stage. The power levels of the light emitting diodes may be direct proportioned to or inverse proportioned to the switching clock signal.

In addition to the above-described power control signal and flicker control signal for respectively controlling the power levels and blinking states, a pulse width modulation signal is used as a power/blinking control signal in the present invention. In addition to the case where a constant current is used, the power levels of the light emitting diodes may have a stagewise increasing or stagewise decreasing relationship with respect to the amplitude of the pulse width modulation signal; the blinking periods of the light emitting diodes may be associated with the blinking control signals and the memorized blinking states.

According to the object of the present invention, there is further provided a control method of a LED controlling driver. The control method of a LED controlling driver comprises the following steps:

Providing a light source having a plurality of power levels or a plurality of blinking states;

Supplying the light source with desired electric power; and

Controlling one of various power levels or various blinking states of the light source or a combination thereof based on switching information of the electric power.

The above-described control method of a LED controlling driver further comprises a step of selectively performing one of a plurality of switching modes based on a switching action inputted by a user to switch the switching information so that the light source may be set to different power levels or in different blinking states as the user expects.

The above-described control method of a LED controlling driver further comprises the step of switching the switching information based on a switching action in the power switch inputted by a user to selectively perform one of a plurality of switching modes, so as to control one of the various power levels or the various blinking states of the light source or a combination thereof.

The above-described control method of n LED controlling driver further comprises a step of achieving one of the various power levels of the light source or a combination thereof based on a power control signal, wherein the power control signal may be a current control signal. Moreover, the various power levels of the light source may have a stagewise increasing or stagewise decreasing relationship with respect to the current control signal.

The above-described control method of an LED controlling driver further comprises the step of achieving one of the various blinking states of the light source or a combination thereof based on a blinking control signal and the blinking control signal may be a switching clock signal. Moreover, the various blinking states of the light source may be directly proportional or inversely proportional to the switching clock signal.

The above-described control method of an LED controlling driver further comprises the step of using a pulse width modulation signal as a power/blinking control signal. The amplitude of the pulse width modulation signal may control the various power levels of the light source and has a stagewise increasing or stagewise decreasing relationship with respect to the power levels of the light source; the frequency of the pulse width modulation signal may control the blinking states of the light source and also has a stagewise increasing or stagewise decreasing relationship with respect to the blinking states of the light source.

As described above, the LED controlling driver comprises a detection-control module, a power supply unit and a power switch and the control method thereof according to the present invention may have one or more of the following advantages:

(1) In the LED controlling driver and the controlling method thereof, multiple switching modes may be used to adjust the power levels or the blinking states so that electric power may be effectively utilized to reduce the power consumption required.

(2) The LED controlling driver and the controlling method thereof may be integrated with conventional LED driver ICs by a semiconductor manufacturing process to achieve the control of the power levels or the blinking states. This can effectively decrease the number of parts required, and thus reduce the cost.

(3) In the LED controlling driver and the controlling method thereof, the power memory unit or the blinking state memory unit used only requires memory power maintained for 2 to 5 seconds, thus power saving is the advantage.

DETAILED DESCRIPTION OF THE PREFERRED EMBODIMENTS

Figure 1:
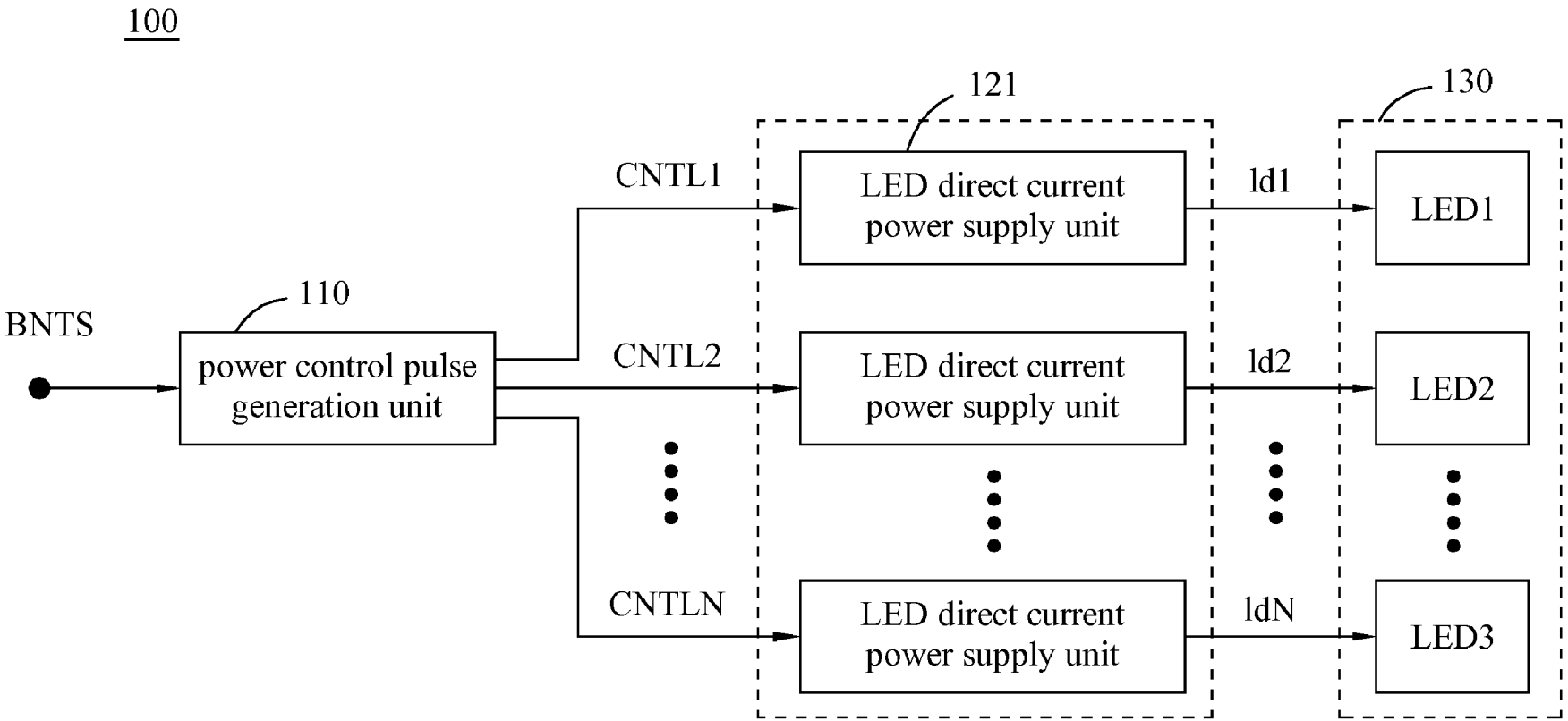
FIG.1 (Prior Art)
FIG. 1 is a circuit diagram of a power control circuit of a LED according to the prior art.

The LED controlling driver and the controlling method thereof according to the present invention will be described hereinbelow with reference to the related drawings. For the convenience of understanding the description, the same elements in the embodiments will be given the same reference numerals.

Figure 2:
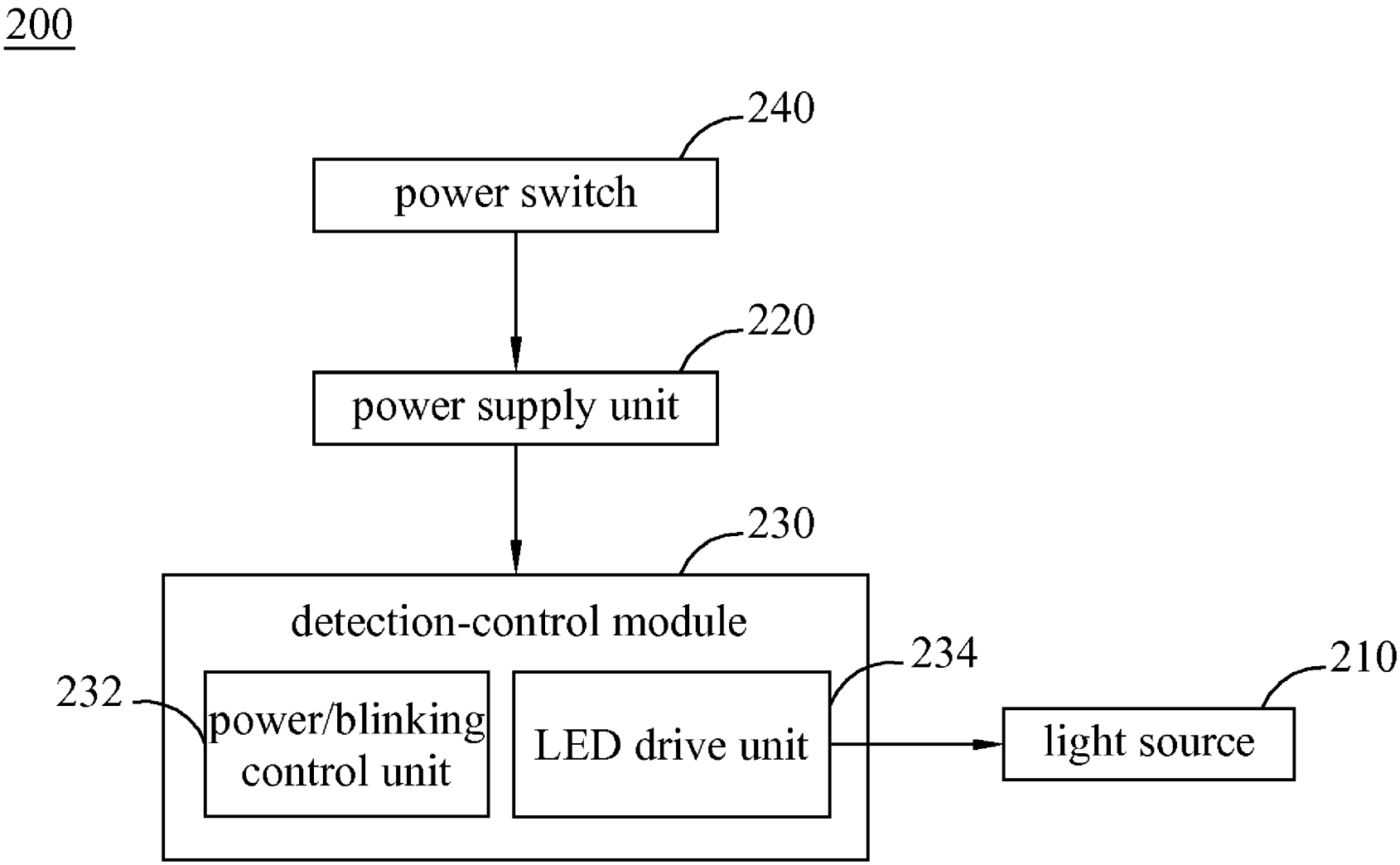
FIG. 2 is a block schematic diagram of a LED controlling driver according to the present invention.

Referring to FIG. 2, there is illustrated a block schematic diagram of a LED controlling driver according to the present invention. In this figure, the LED controlling driver 200 comprises a light source 210, a power supply unit 220, a detection-control module 230 and a power switch 240. The light source 210 is comprised of at least one light emitting diode, and also may comprise a plurality of light emitting diodes. The light source 210 has a plurality of power levels or a plurality of blinking states corresponding to a plurality of switching modes. The detection-control module 230 is coupled to the above-described light source 210, and includes a power/blinking control unit 232 and an LED drive unit 234. The power/blinking control unit 232 may generate a power/blinking control signal based on switching information to control one of the plurality of power levels or the plurality of blinking states of the plurality of light emitting diodes of the light source or a combination thereof. Here, the switching information may include a number of switching events or a length of switching time of the power switch. The output signal level or the length of output signal time set in the detection-control module 230, which is corresponding to the above-mentioned switching information, is used to generate a corresponding power/blinking control signal.

The LED drive unit 234 provides intensity of driving electric power corresponding to the actuation threshold of the light emitting diodes of the light source 210. The power supply unit 220 may supply switching power to the light source 210, the detection-control module 230 and other parts of the entire circuit, and may provide different switching information to the detection-control module 230. The power switch 240 enables the power supply unit 220 to be based on a switching action to output the switching information corresponding to the switching action inputted by the user, so as to control the light emitting diodes of the light source.

Figure 3:
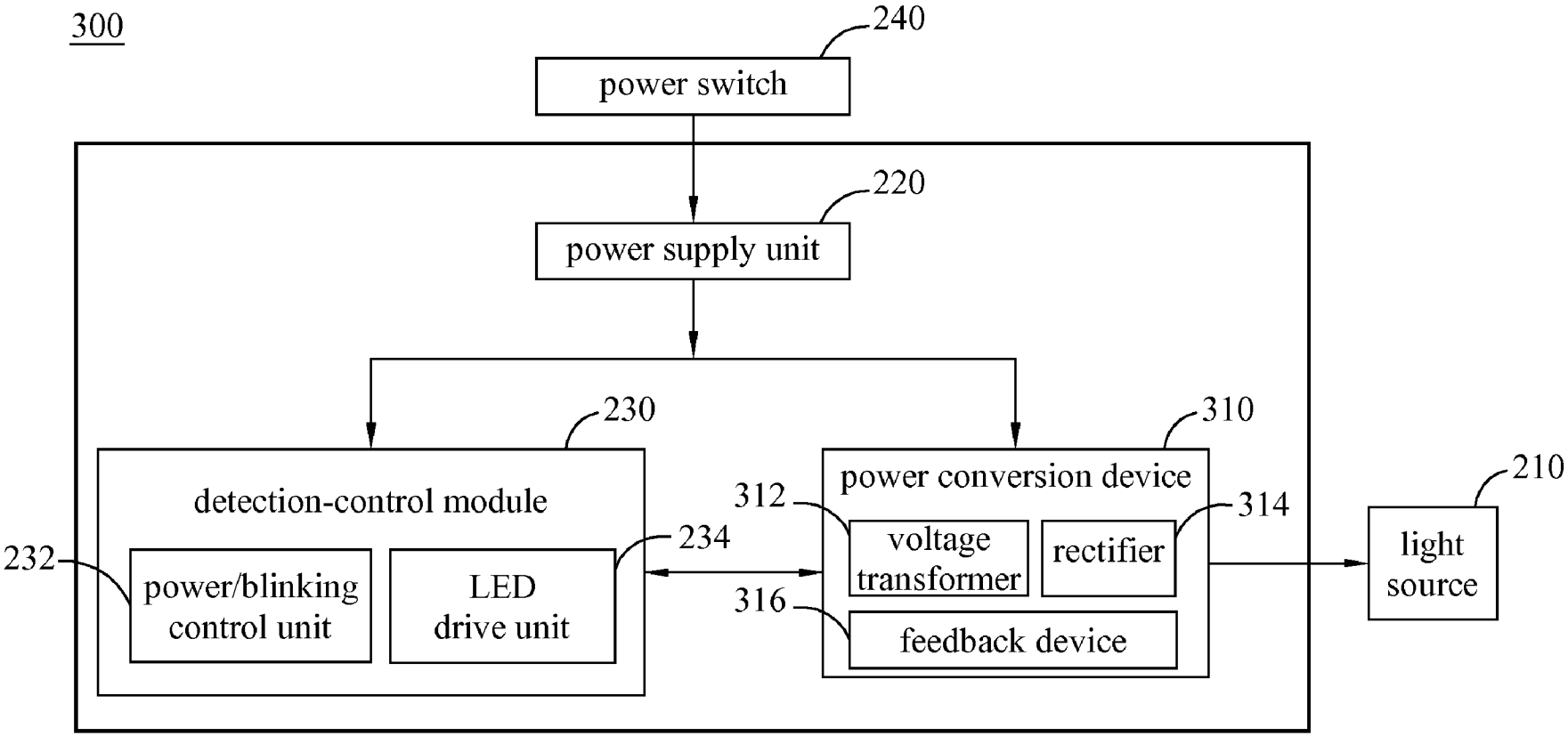
FIG. 3 is a block schematic diagram of a LED controlling driver according to an embodiment of the present invention.

Referring to FIG. 3, there is illustrated a block schematic diagram of a LED controlling driver according to an embodiment of the present invention. In this figure, the elements, which are the same as those shown in FIG. 2, are denoted by the same reference numerals, and therefore only the differences will be described hereinafter. A power conversion device 310 may be further disposed between the detection-control module 230 and the light, source 210 according to the present invention for receiving driving electric power corresponding to the intensity of driving electric power outputted by the power supply unit 220. The driving electric power is switching power. The power conversion device 310 may include a voltage transformer 312, a rectifier 314 and a feedback device 316. The voltage transformer 312 transforms the magnitude of a voltage of the driving electric power; the rectifier 314 converts a current of the driving electric power into a direct current; the feedback device 316 converts a gain value of the driving electric power. The feedback device 316 may be a current detection feedback device and may be implemented using resistors or optocouplers. In other embodiments, the power conversion device 310 may be omitted and only the LED drive unit 234 is used to directly drive the light source 210.

Figure 4:
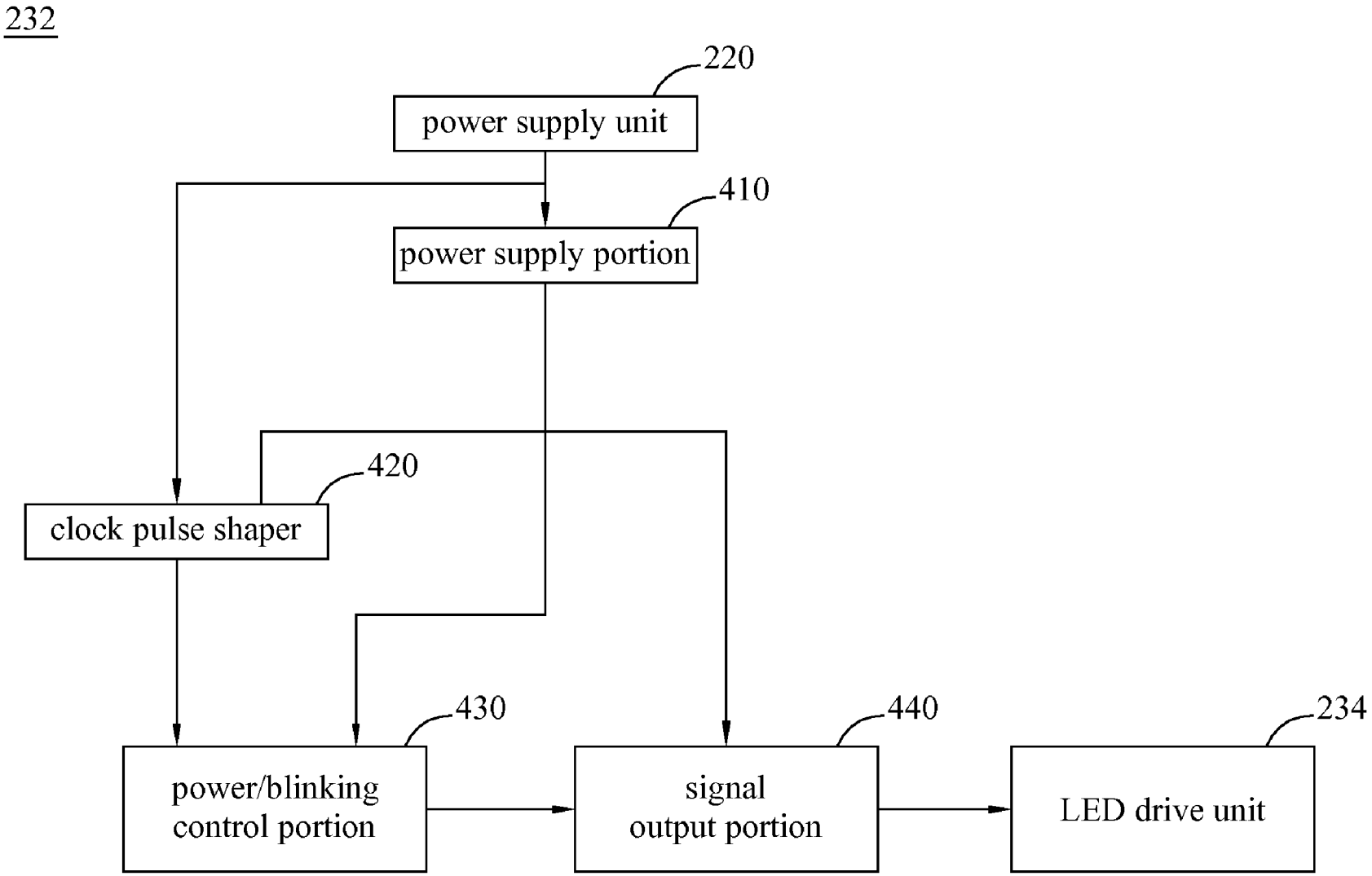
FIG. 4 is a block schematic diagram of a power/blinking control unit according to the present invention.

Referring to FIG. 4, there is illustrated a block schematic diagram of a power/blinking control unit according to the present invention. In this figure, the power/blinking control unit 232 may include a power supply portion 410, a clock pulse shaper 420, a power/blinking control portion 430 and a signal output portion 440.

Figure 5:
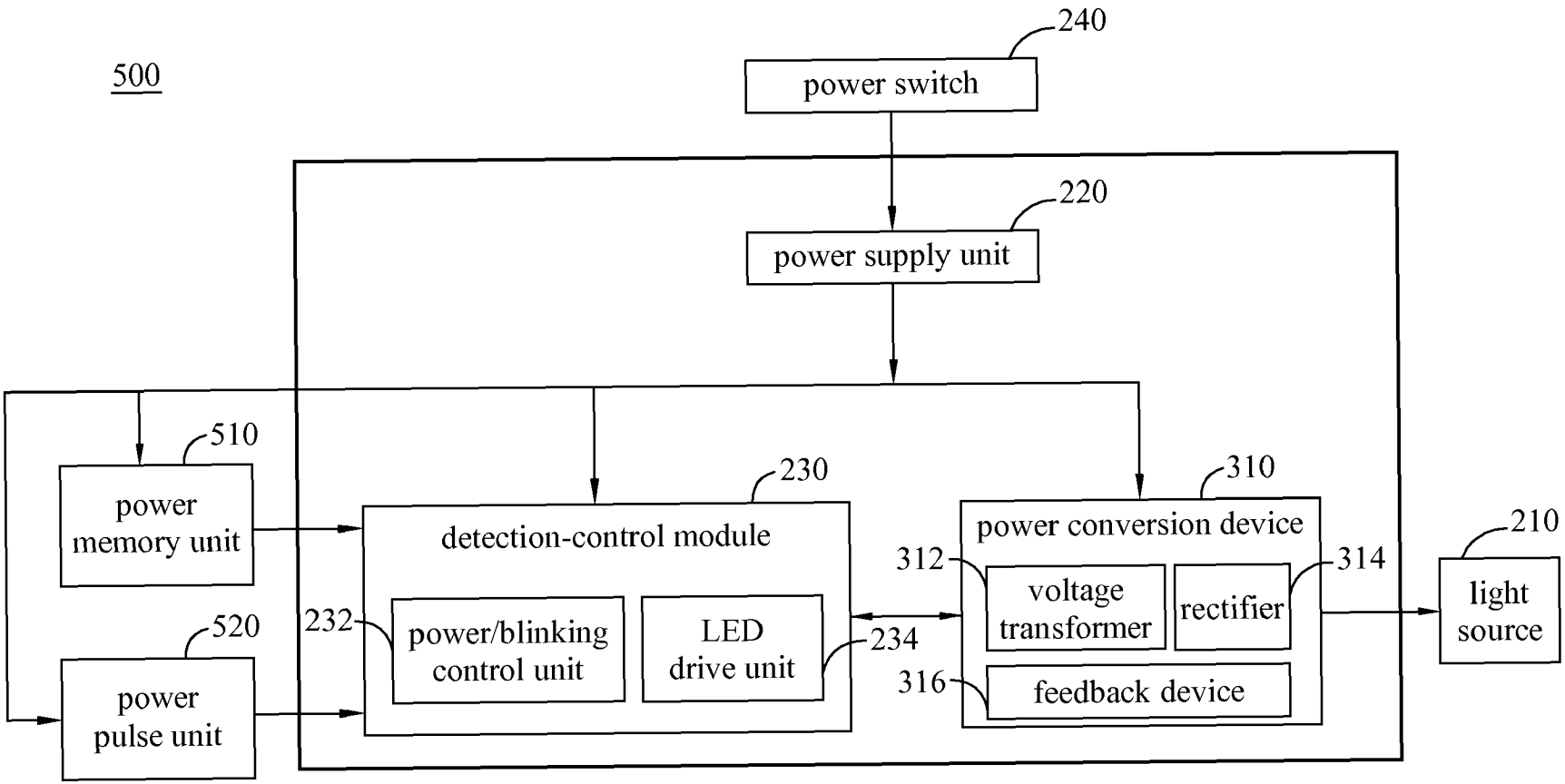
FIG. 5 is a block schematic diagram of a LED controlling driver according to another embodiment of the present invention.

Referring to FIG. 5, there is illustrated a block schematic diagram of a LED controlling driver according to another embodiment of the present invention. In this figure, the elements, which are the same as those shown in FIG. 3, are denoted by the same reference numerals, and therefore only the differences will be described hereinafter. In addition to the case where the structure as shown in FIG. 4 is used to generate power/blinking control signals, a power memory unit 510 and a power pulse unit 520 may be connected to the exterior of the detection-control module 230 of the present invention. The power memory unit 510 is coupled to the detection-control module 230 to provide the detection-control module 230 with maintaining power so that the detection-control module 230 can memorize power values corresponding to the power levels. For example, it can store the power value corresponding to the power level displayed by the light emitting diodes of the light source last time. The power pulse unit provides a power pulse signal based on the switching information so that the detection-control module 230 can suitably load the power value corresponding to the above-described power level and output a power control signal to control the power level of the light emitting diodes of the light source. Here, the power value of the power control signal may be different from or may be the same as the power value of the power level displayed last time. Specifically, for example, if the interval between the present time and the next time at which the clock signal is inputted is less than 2 seconds, the power control signal is switched to the next stage; if the interval between the present time and the next time at which the clock signal is inputted is more than 2 seconds, the power control signal returns to the initial value, but the present invention is not limited thereto. Specifically, if the power states can be divided into dark, dim, normal, bright and luminous states, when the power level displayed last time is the normal power level, the next stage described herein may be in the bright state, but the present invention is not limited thereto. For example, the next stage may also be in the dim state.

In practical implementation of the above-mentioned embodiments, the above-described power memory unit may be one of a capacitor circuit, an RC circuit, a diode switch circuit, a transistor switch circuit, or a combination thereof, but the present invention is not limited thereto. The power control signal may be a current control signal, and the power levels of the light emitting diodes may have a stagewise increasing or stagewise decreasing relationship with respect to the current control signal based on different circuit designs.

Figure 6:
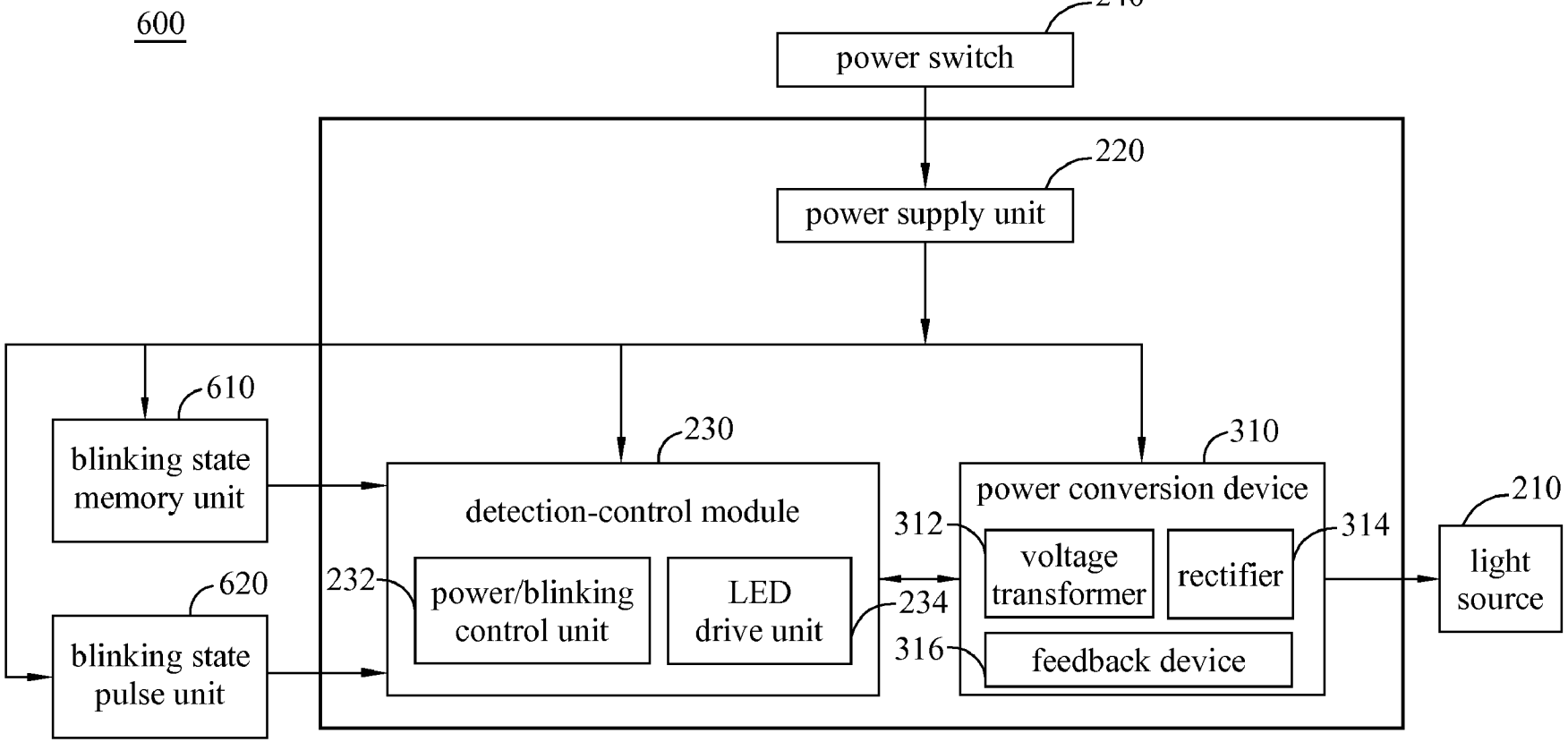
FIG. 6 is a block schematic diagram of a LED controlling driver according to still another embodiment of the present invention.

Referring to FIG. 6, there is illustrated a block schematic diagram of a LED controlling driver according to still another embodiment of the present invention. In this figure, the elements, which are the same as those shown in FIG. 3, are denoted by the same reference numerals, and therefore only the differences will be described hereinafter. A blinking state memory unit 610 and a blinking state pulse unit 620 may be connected to the exterior of the detection-control module 230 of the present invention. The blinking state memory unit 610 is coupled to the detection-control module 230 to provide the detection-control module 230 with maintaining power so that the detection-control module 230 can memorize blinking state values corresponding to the blinking states. For example, it can store the blinking state value corresponding to a blinking state displayed by the light emitting diodes of the light source last time. The blinking state pulse unit 620 provides a blinking state pulse signal based on the switching information so that the detection-control module 230 can suitably load the blinking state value corresponding to the above-described blinking state and output a flicker control signal to control the blinking state of the light emitting diodes of the light source. Here, the blinking state value of the blinking control signal may be different from or may be the same as the blinking state value of the blinking state displayed last time. Specifically, for example, if the interval between the present time and the next time at which the clock signal is inputted is less than 2 seconds, the blinking control signal is switched to the next stage; if the interval between the present time and the next time at which the clock signal is inputted is more than 2 seconds, the blinking control signal returns to the initial value, but the present invention is not limited thereto. Specifically, if the blinking state memory unit 610 is implemented using a parallel circuit of two capacitors and the blinking states can be divided into LL(00), LH(01), HL(10) and HH(11) based on electric potentials, when the blinking state of LH(01) was displayed last time, the light emitting diodes may enter the blinking state of HL(10) at the next stage, but the present invention is not limited thereto. For example, they may also enter the blinking state of HH(11) at the next stage, but the present invention is not limited thereto. Alternatively, for example, another capacitor circuit may be added to the blinking state memory unit so as to include 8 blinking states of LLL(000), LLH(001), LHL(010), LHH (011), HLL(100), HLH(101), HHL(110) and HHH(111).

In practical implementation of the above-mentioned embodiments, the above-described blinking state memory unit may be one of a capacitor circuit, an RC circuit, a diode switch circuit, a transistor switch circuit, or a combination thereof, but the present invention is not limited thereto. The power control signal may be a current control signal, and the blinking states of the light emitting diodes may have a stagewise increasing or stagewise decreasing relationship with respect to the switching clock signal based on different circuit designs.

In addition to the case where the current control signal serves as a power control signal serves; the switching clock signal serves as a blinking control signal, a pulse width modulation signal is used as a power/blinking control signal in the present invention. The power levels of the light emitting diodes may have a stagewise increasing or stagewise decreasing relationship with respect to the amplitude of the pulse width modulation signal; the blinking states of the light emitting diodes may have a stagewise increasing or stagewise decreasing relationship with respect to the frequency of the pulse width modulation signal.

Figure 7:
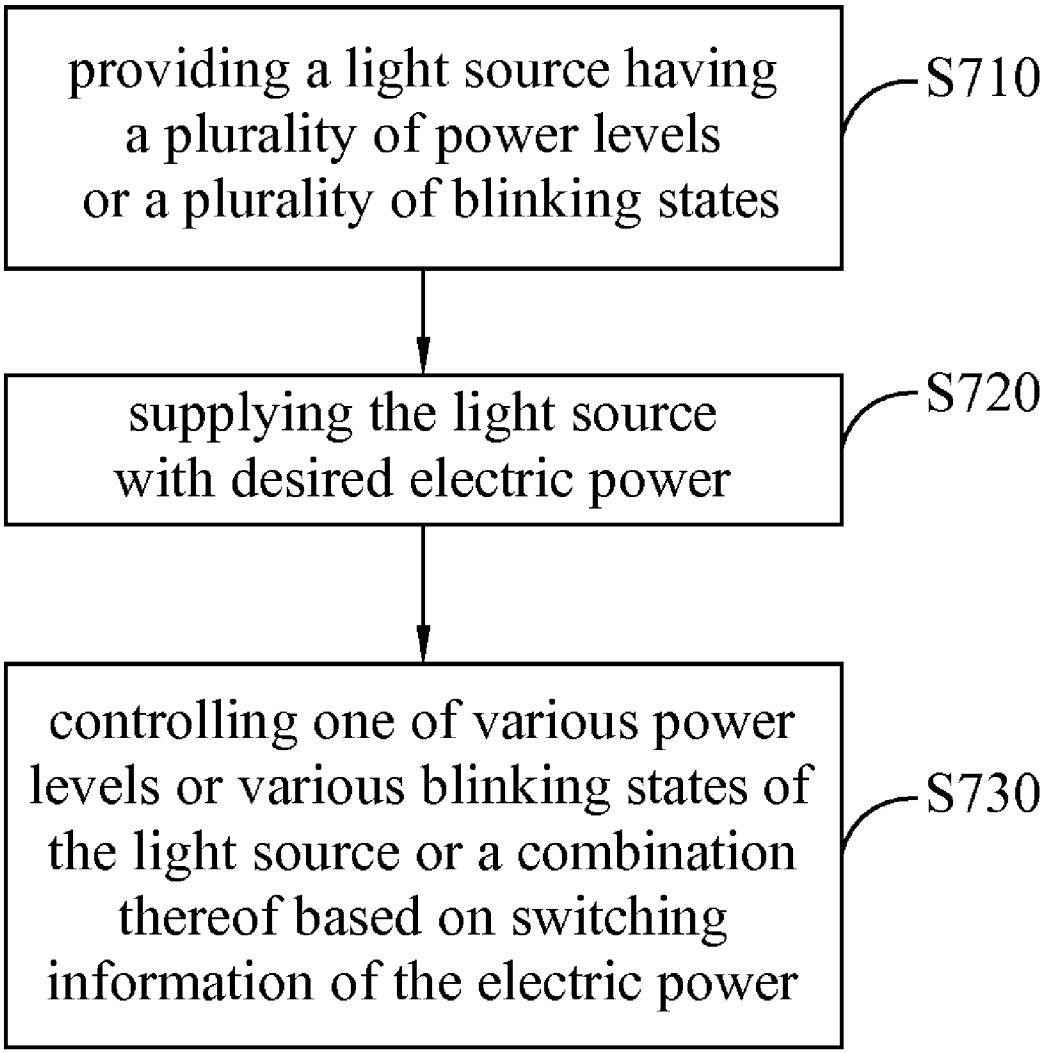
FIG. 7 is a schematic flow diagram showing a control method of a LED controlling driver according to an embodiment of the present invention.

Referring to FIG. 7, there is illustrated a schematic flow diagram showing a control method of an LED driver with a switch detector and a power control device according to an embodiment of the present invention. The method comprises the following steps:

S710: providing a light source 210 having a plurality of power levels or a plurality of blinking states;

S720: supplying the light source 210 with desired electric power; and

S730: controlling one of various power levels or various blinking states of the light source 210 or a combination thereof based on switching information of the electric power.

Furthermore, the above-described controlling method of a LED controlling driver comprises switching the switching information based on a switching action inputted by a user to selectively perform one of a plurality of switching modes, so as to control one of the power levels or the blinking states of the light source or a combination thereof.

Furthermore, the above-described controlling method of a LED controlling driver further comprises the step of achieving one of the various power states of the light source or a combination thereof based on a power control signal. The power control signal is a current control signal, so that the power levels of the light source are controlled to stagewise increase or stagewise decrease with the current control signal.

Furthermore, the above-described controlling method of a LED controlling driver further comprises the step of achieving one of the various blinking states of the light source or a combination thereof based on a flicker control signal. The blinking control signal may be a switching clock signal, so that the blinking states of the light source are controlled to be directly proportional or inversely proportional to the switching clock signal.

Furthermore, the power/blinking control signal may be a pulse width modulation signal, so that the power levels of the light source are controlled to stagewise increase or stagewise decrease with the amplitude of the pulse width modulation signal, and the blinking states of the light source are controlled to stagewise increase or stagewise decrease with the frequency of the pulse width modulation signal.

The above description is illustrative only and is not to be considered limiting. Various modifications or changes can be made without departing from the spirit and scope of the invention. All such equivalent modifications and changes shall be included within the scope of the appended claims.

What is claimed is:

1. A LED controlling driver, comprising:

a light source comprising at least one light emitting diode, and the light source comprising a plurality of power levels or a plurality of blinking states;

a detection-control module coupled to the light source and comprising:

a control unit detecting a switching action and generating a control signal based on switching information to control one of the power levels or the blinking states of the at least one light emitting diodes of the light source or a combination thereof; and a LED driver providing a driving electric signal corresponding to an actuation threshold of the at least one light emitting diode of the light source;

a power supply unit outputting power to the light source and the detection-control module to provide the detection-control module with the switching information; and a power conversion unit between the light source and the detection-control module, the power conversion unit receiving a driving electric power corresponding to the electric signal outputted by the power supply unit, and the power conversion unit comprising:

a voltage transformer for transforming a voltage of the driving electric power;

a rectifier for converting current of the driving electric power; and a feedback device for converting a gain value of the driving electric power.

2. The LED controlling driver as set forth in claim 1, further comprising a power switch, wherein the power switch enables the power supply unit to output the corresponding switching information based on the switching action inputted by a user.

3. The LED controlling driver as set forth in claim 1, wherein the power supply unit provides switching power.

4. The LED controlling driver as set forth in claim 1, further comprising:

a power memory unit coupled to the detection-control module and providing the detection-control module with maintaining power, wherein the detection-control module memorizes a power value corresponding to the power levels; and a power pulse unit providing a power pulse signal based on the switching information, and the detection-control module loading the power value corresponding to the power levels.

5. The LED controlling driver as set forth in claim 4, wherein the power memory unit is one of a capacitor circuit, an RC circuit, a diode switch circuit, a transistor switch circuit, or a combination thereof.

6. The LED controlling driver as set forth in claim 4, wherein the power control signal is a current control signal, and the power levels of the at least one light emitting diode stagewise increase or stagewise decrease according to the current control signal.

7. The LED controlling driver as set forth in claim 1, further comprising:

a blinking state memory unit coupled to the detection-control module and providing the detection-control module with maintaining power, and the detection-control module memorizing a blinking state value corresponding to the blinking states; and a blinking state pulse unit providing a blinking state pulse signal based on the switching information, and the detection-control module loading the blinking state value corresponding to the blinking states.

8. The LED controlling driver as set forth in claim 7, wherein the blinking state memory unit is one of a capacitor circuit, an RC circuit, a diode switch circuit, a transistor switch circuit, or a combination thereof.

9. The LED controlling driver as set forth in claim 7, wherein the blinking control signal is a switching clock signal, and the power levels of the at least one light emitting diode is proportioned to or inverse proportioned to the switching clock signal.

10. The LED controlling driver as set forth in claim 1, wherein the control signal is a pulse width modulation signal, and the power level of the at least one light emitting diode stagewise increases or stagewise decreases according to the amplitude of the pulse width modulation signal; and the blinking state of the at least one light emitting diode stagewise increases or stagewise decreases according to the frequency of the pulse width modulation signal.

11. A controlling method of a LED controlling driver, comprising following steps:

providing a light source comprising a plurality of power levels or a plurality of blinking states;

supplying the light source with desired electric power;

controlling the power levels of the light source, the blinking states of the light source, or a combination thereof based on the switching information of the electric power; and achieving the blinking states of the light source based on a blinking control signal;

wherein the blinking control signal is a switching clock signal and the blinking states of the light source are controlled proportionally to or inversely proportionally to the switching clock signal.

12. The controlling method of a LED controlling driver as set forth in claim 11, further comprising a step of switching the switching information based on a switching action inputted by a user to selectively perform one of a plurality of switching modes, and controlling one of the power levels and the blinking states of the light source or a combination thereof.

13. The controlling method of a LED controlling driver as set forth in claim 11, further comprising a step of achieving one of the power levels of the light source or a combination thereof based on a power control signal.

14. The controlling method of a LED controlling driver as set forth in claim 13, wherein the power control signal is a current control signal, and the power levels of the light source are controlled to stagewise increase or stagewise decrease according to the current control signal.

15. The controlling method of a LED controlling driver as set forth in claim 11, wherein the control signal is a pulse width modulation signal, and the power levels of the light source are controlled to stagewise increase or stagewise decrease according to the amplitude of the pulse width modulation signal, and the blinking states of the light source are controlled to stagewise increase or stagewise decrease according to the frequency of the pulse width modulation signal.

16. A LED controlling driver, comprising:

a light source comprising at least one light emitting diode, and the light source comprising a plurality of power levels or a plurality of blinking states;

a detection-control module coupled to the light source and comprising:

a control unit detecting a switching action and generating a control signal based on switching information to control one of the power levels or the blinking states of the at least one light emitting diodes of the light source or a combination thereof; and a LED driver providing a driving electric signal corresponding to an actuation threshold of the at least one light emitting diodes of the light source;

a power supply unit outputting power to the light source and the detection-control module to provide the detection-control module with the switching information;

a power memory unit coupled to the detection-control module and providing the detection-control module with maintaining power, wherein the detection-control module detects a power value corresponding to one of the power levels; and a power pulse unit providing a power pulse signal based on the switching information, and the detection-control module loading the power value corresponding to the power levels.

17. The LED controlling driver as set forth in claim 16, wherein the power memory unit is one of a capacitor circuit, an RC circuit, a diode switch circuit, a transistor switch circuit, or a combination thereof.

18. The LED controlling driver as set forth in claim 16, wherein the power control signal is a current control signal, and the power levels of the at least one light emitting diode stagewise increase or stagewise decrease according to the current control signal.

19. A LED controlling driver, comprising:

a light source comprising at least one light emitting diode, and the light source comprising a plurality of power levels or a plurality of blinking states;

a detection-control module coupled to the light source and comprising:

a control unit detecting a switching action and generating a control signal based on switching information to control one of the power levels or the blinking states of the at least one light emitting diodes of the light source or a combination thereof; and a LED driver providing a driving electric signal corresponding to an actuation threshold of the at least one light emitting diodes of the light source;

a power supply unit outputting power to the light source and the detection-control module to provide the detection-control module with the switching information;

a blinking state memory unit coupled to the detection-control module and providing the detection-control module with maintaining power, and the detection-control module detecting a blinking state value corresponding to the blinking states; and a blinking state pulse unit providing a blinking state pulse signal based on the switching information, and the detection-control module loading the blinking state value corresponding to the blinking states.

20. The LED controlling driver as set forth in claim 19, wherein the blinking state memory unit is one of a capacitor circuit, an RC circuit, a diode switch circuit, a transistor switch circuit, or a combination thereof.

21. The LED controlling driver as set forth in claim 19, wherein the blinking control signal is a switching clock signal, and the power levels of the at least one light emitting diode is proportioned to or inverse proportioned to the switching clock signal.

* * * * *